US008823760B2

(12) United States Patent
Miyadera

(10) Patent No.: US 8,823,760 B2
(45) Date of Patent: Sep. 2, 2014

(54) OPTICAL WRITING CONTROL APPARATUS, IMAGE FORMING APPARATUS, AND OPTICAL WRITING CONTROL METHOD

(71) Applicant: Tatsuya Miyadera, Kanagawa (JP)

(72) Inventor: Tatsuya Miyadera, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/070,921

(22) Filed: Nov. 4, 2013

(65) Prior Publication Data

US 2014/0125752 A1 May 8, 2014

(30) Foreign Application Priority Data

Nov. 8, 2012 (JP) ..... 2012-246249

(51) Int. Cl.
*B41J 2/435* (2006.01)
*B41J 2/47* (2006.01)

(52) U.S. Cl.
USPC ..... 347/234; 347/229; 347/248

(58) Field of Classification Search
CPC ..... G03G 2215/0029; G03G 2215/0037; G03G 2215/00042; G03G 2215/00059; G03G 2215/0158; G03G 2215/0161
USPC ..... 347/116, 229, 234, 235, 240, 246–248, 347/251–254; 358/1.9, 2.1, 518, 519, 523; 399/49, 51, 60, 72
See application file for complete search history.

(56) References Cited

U.S. PATENT DOCUMENTS

| | | | | |
|---|---|---|---|---|
| 8,565,634 | B2 * | 10/2013 | Nakazato et al. | 399/72 |
| 8,638,481 | B2 * | 1/2014 | Miyadera et al. | 358/518 |
| 2003/0137577 | A1 * | 7/2003 | Shinohara | 347/134 |
| 2008/0239400 | A1 | 10/2008 | Yoshida | |
| 2011/0026082 | A1 | 2/2011 | Miyadera et al. | |
| 2012/0288291 | A1 | 11/2012 | Miyadera | |
| 2013/0070040 | A1 | 3/2013 | Miyadera et al. | |

FOREIGN PATENT DOCUMENTS

| | | |
|---|---|---|
| JP | 63-245175 | 10/1988 |
| JP | 2001-209292 | 8/2001 |
| JP | 2004-191459 | 7/2004 |
| JP | 2007-121907 | 5/2007 |
| JP | 2008-238459 | 10/2008 |
| JP | 2010-244029 | 10/2010 |
| JP | 2012-126083 | 7/2012 |
| JP | 2013-064811 | 4/2013 |

* cited by examiner

*Primary Examiner* — Hai C Pham
(74) *Attorney, Agent, or Firm* — Harness, Dickey & Pierce, P.L.C.

(57) ABSTRACT

In the present invention, a detection timing of a density correction pattern is determined by correcting a timing that is determined in advance as a detection timing of the density correction pattern, based on a ratio between a conveying speed of a recording medium to which a developed image is transferred and a conveying speed of a conveying belt for conveying the image and based on a detection result of the positional deviation correction pattern.

5 Claims, 9 Drawing Sheets

OPTICAL WRITING CONTROL APPARATUS, IMAGE FORMING APPARATUS, AND OPTICAL WRITING CONTROL METHOD

CROSS-REFERENCE TO RELATED APPLICATIONS

The present application claims priority to and incorporates by reference the entire contents of Japanese Patent Application No. 2012-246249 filed in Japan on Nov. 8, 2012.

BACKGROUND OF THE INVENTION

1. Field of the Invention

The present invention relates to an optical writing control apparatus, an image forming apparatus, and an optical writing control method, and in particular, to a technology for controlling a detection timing to detect a drawn image.

2. Description of the Related Art

In recent years, more and more information is made into electronic forms, and image processing apparatuses, such as a printer and a facsimile machine used to output electronic information and a scanner used to electronic documents, have been playing an essential role. Such an image processing apparatus is often configured as a multifunction peripheral (MFP) that has an imaging function, an image forming function, and a communication function so as to be used as a printer, a facsimile machine, a scanner, and a copier.

Among the image processing apparatuses as described above, an electrophotographic image forming apparatus is widely used as an image forming apparatus for outputting electronic documents. The electrophotographic image forming apparatus forms an electrostatic latent image by exposing a photoreceptor, develops the electrostatic latent image with a developer, such as toner, to form a toner image, transfers the toner image to a sheet of paper, and outputs the sheet of paper.

In the electrophotographic image forming apparatus as described above, a timing at which the electrostatic latent image is drawn by exposure of the photoreceptor and a conveying timing of the sheet of paper are synchronized so that the image can be formed in a correct area of the sheet of paper. Furthermore, in a tandem-type image forming apparatus that forms a color image by using a plurality of photoreceptors, an exposing timing of each of the photoreceptors for different colors is adjusted so that images developed on the photoreceptors of the colors can accurately be superimposed one on top of the other (see, for example, Japanese Patent Application Laid-open No. 2004-191459). In the following, the above-described adjustment processes are collectively referred to as positional deviation correction.

As a concrete example of a method to implement the positional deviation correction as described above, a mechanical adjustment method is known, in which a positional relationship between a photoreceptor and a light source that exposes the photoreceptor is adjusted. Furthermore, a method using image processing is also known, in which an image to be output is adjusted according to a positional deviation so that the image can be formed at a preferable position in an end product. In the method using the image processing, the image to be output is shifted in the sub-scanning direction so that the image can be formed at a desired position.

The electrophotographic image forming apparatus also performs, in addition to the positional deviation correction, density correction in which an adjustment value is obtained to adjust the intensity of light used to adjust the photoreceptor or to adjust a developing bias for developing an electrostatic latent image so that a desired density can be obtained in an image to be output.

In the correction operation as described above, it is necessary to draw and read a correction pattern, so that toner is consumed. Therefore, to reduce the toner consumption, there is a need to draw the correction pattern as small as possible. Incidentally, when a density correction pattern is to be read, if the spot of light from a sensor that reads the pattern is applied across a pattern drawing area and a background area, a density detection error occurs. Therefore, it is necessary to drive the sensor while the pattern drawn and conveyed is covering a detection position of the sensor.

To draw the density correction pattern in a smaller size and to drive the sensor while the pattern is covering the detection position of the sensor as described above, it is necessary to synchronize a timing at which the pattern is drawn and conveyed to the detection position of the sensor and a drive timing of the sensor. However, in the electrophotographic image forming apparatus including various mechanisms, such as an image forming mechanism provided with an optical writing device and a photosensitive drum or a conveying mechanism such as a belt for conveying a developed image, it is difficult to synchronize the timings with high accuracy.

Therefore, there is a need for an electrophotographic image forming apparatus capable of performing the positional deviation correction in the sub-scanning direction with high accuracy while reducing a drawing area of the density correction pattern.

SUMMARY OF THE INVENTION

It is an object of the present invention to at least partially solve the problems in the conventional technology.

According to the present invention, there is provided: an optical writing control apparatus configured to cause light sources that expose photoreceptors to form electrostatic latent images on the photoreceptors, the optical writing control apparatus comprising: a light-emission control unit configured to cause a plurality of light sources provided for different colors to emit light based on pixel information of an image to be formed and output, to thereby expose the photoreceptors for the respective colors; a detection signal acquiring unit configured to acquire a detection signal from a sensor, the sensor being configured to detect images developed from the electrostatic latent images formed on the photoreceptors in a conveying path on which the images are transferred and conveyed; and a density-correction-pattern detection timing determining unit configured to determine a detection timing of a density correction pattern that is used to correct a density of each of the images developed from the electrostatic latent images, based on a detection result of a positional deviation correction pattern that is used to correct a positional deviation between the images developed from the electrostatic latent images of the respective colors in the sub-scanning direction.

In the above-described optical writing control apparatus, the light-emission control unit first controls light emission of the light sources for forming the positional deviation correction pattern and thereafter controls light emission of the light sources for forming the density correction pattern, the detection signal acquiring unit acquires the detection signal of the sensor based on the determined detection timing of the density correction pattern, to thereby acquire the detection result of the density correction pattern, and the density-correction-pattern detection timing determining unit determines the detection timing of the density correction pattern by correcting a predetermined timing, which is determined in advance as the detection timing of the density correction pattern, based on a ratio between a conveying speed of a recording medium to which the images developed from the electrostatic latent images are transferred and a conveying speed of the conveying path for conveying the images developed from the electrostatic latent images.

The present invention also provides an image forming apparatus comprising the optical writing control apparatus mentioned above.

The present invention also provides an optical writing control method for causing light sources that expose photoreceptors to form electrostatic latent images on the photoreceptors, the optical writing control method comprising: first controlling light emission of the light sources for forming a positional deviation correction pattern that is used to correct a positional deviation between images of different colors developed from the electrostatic latent image formed on the photoreceptors for the respective colors in the sub-scanning direction; second controlling, after the first controlling, light emission of the light sources for forming a density correction pattern that is used to correct a density of each of the images developed from the electrostatic latent images; acquiring a detection signal from a sensor, the sensor being configured to detect the images developed from the electrostatic latent images in a conveying path on which the images are transferred and conveyed; determining a detection timing of the density correction pattern by correcting a predetermined timing, which is determined in advance as the detection timing of the density correction pattern, based on a ratio between a conveying speed of a recording medium to which the images developed from the electrostatic latent images are transferred and a conveying speed of the conveying path for conveying the images developed from the electrostatic latent images; and acquiring a detection result of the density correction pattern by acquiring the detection signal of the sensor according to the determined detection timing of the density correction pattern.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings. In the embodiments explained below, a multifunction peripheral (MFP) is employed as an example of the image forming apparatus. The image forming apparatus of the embodiments is an electrophotographic image forming apparatus configured to perform a process for adjusting positions in the sub-scanning direction at which toner images developed on photoreceptors are transferred.

Figure 1:
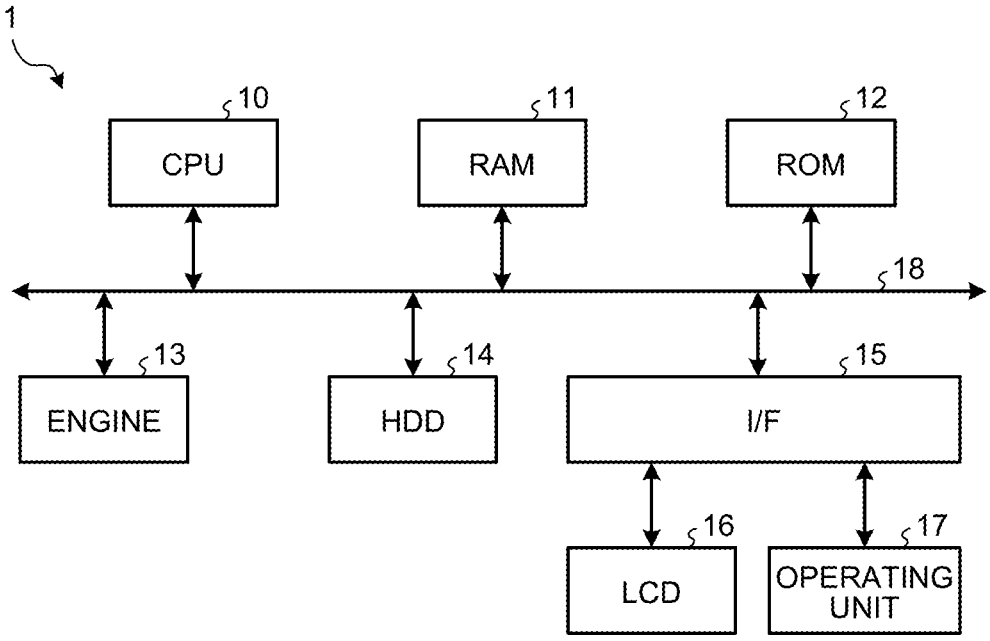
FIG. 1 is a block diagram illustrating a hardware configuration of an image forming apparatus according to an embodiment of the present invention.

FIG. 1 is a block diagram illustrating a hardware configuration of an image forming apparatus 1 according to an embodiment. As illustrated in FIG. 1, the image forming apparatus 1 according to the embodiment includes an engine for forming images, in addition to the same components as those of an information processing apparatus, such as a general server or a personal computer (PC). Specifically, the image forming apparatus 1 according to the embodiment includes a central processing unit (CPU) 10, a random access memory (RAM) 11, a read only memory (ROM) 12, an engine 13, a hard disk drive (HDD) 14, and an interface (I/F) 15, all of which are connected to one another via a bus 18. A liquid crystal display (LCD) 16 and an operating unit 17 are connected to the I/F 15.

The CPU 10 is an arithmetic unit and controls the entire operation of the image forming apparatus 1. The RAM 11 is a volatile storage medium capable of reading and writing information at high speed and is used as a working space by the CPU 10 to process information. The ROM 12 is a read-only nonvolatile storage medium and stores therein programs, such as firmware. The engine 13 is a mechanism that actually forms images in the image forming apparatus 1.

The HDD 14 is a nonvolatile storage medium capable of reading and writing information and stores therein an operating system (OS), various control programs, applications programs, and the like. The I/F 15 connects and controls the bus 18 and various types of hardware or networks. The LCD 16 is a visual user interface that allows a user to check the state of the image forming apparatus 1. The operating unit 17 is a user interface, such as a keyboard or a mouse, that allows a user to input information to the image forming apparatus 1.

In the hardware configuration as described above, by reading the programs stored in a recording medium, such as the ROM 12, the HDD 14, or an optical disk (not illustrated), into the RAM 11 and causing the CPU 10 to perform calculations according to the programs, a software control unit is configured. By combining the hardware and the software control unit configured as above, functional blocks that implement the functions of the image forming apparatus 1 of the embodiment are configured.

Figure 2:
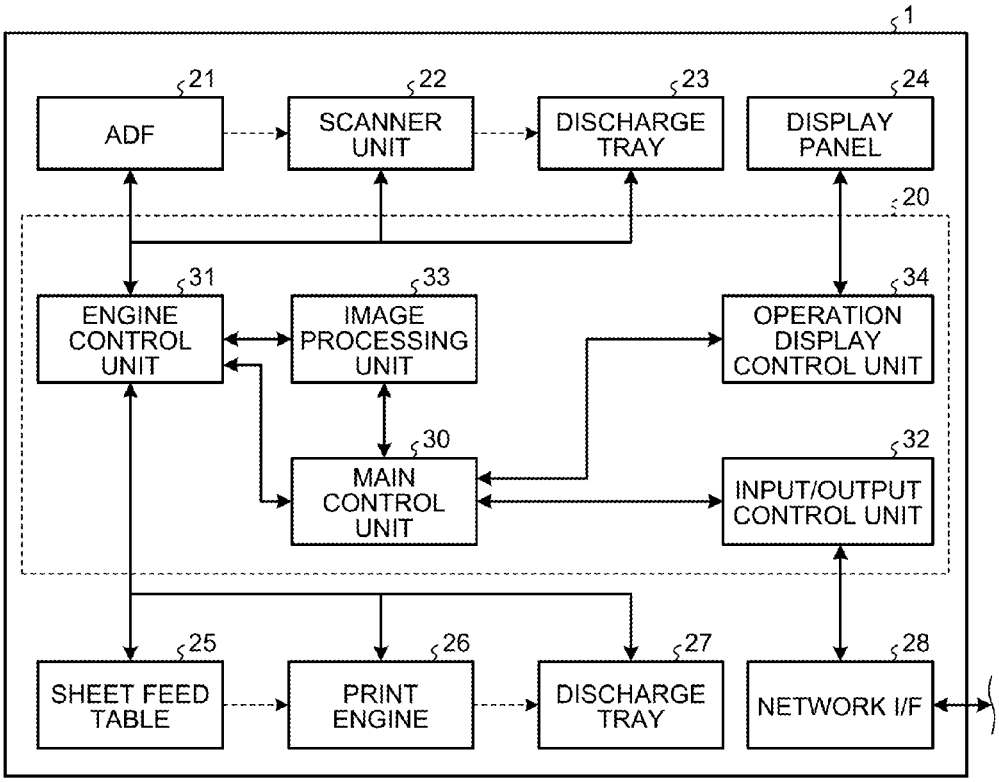
FIG. 2 is a diagram illustrating a functional configuration of the image forming apparatus according to the embodiment of the present invention.

With reference to FIG. 2, a functional configuration of the image forming apparatus 1 according to the embodiment will be explained below. FIG. 2 is a block diagram illustrating the functional configuration of the image forming apparatus 1 according to the embodiment. As illustrated in FIG. 2, the image forming apparatus 1 according to the embodiment includes a controller 20, an auto document feeder (ADF) 21, a scanner unit 22, a discharge tray 23, a display panel 24, a sheet feed table 25, a print engine 26, a discharge tray 27, and a network I/F 28.

The controller 20 includes a main control unit 30, an engine control unit 31, an input/output control unit 32, an image processing unit 33, and an operation display control unit 34. As illustrated in FIG. 2, the image forming apparatus 1 according to the embodiment is configured as an MFP including the scanner unit 22 and the print engine 26. In FIG. 2, electrical connections are indicated by solid arrows, and the flow of a sheet of paper is indicated by dashed arrows.

The display panel 24 serves as an output interface that visually displays the state of the image forming apparatus 1 and also serves as an input interface (an operating unit), as a touch panel, that allows a user to directly operate the image forming apparatus 1 or to input information to the image forming apparatus 1. The network I/F 28 is an interface that allows the image forming apparatus 1 to communicate with other apparatuses via a network, and may be an Ethernet (registered trademark) interface or a universal serial bus (USB) interface.

The controller 20 is a combination of software and hardware. Specifically, the controller 20 includes a software control unit, which is configured by loading a computer program, such as firmware, stored in a nonvolatile recording medium, such as the ROM 12, a nonvolatile memory, the HDD 14, or an optical disk, into a volatile memory (hereinafter, a memory), such as the RAM 11, and causing the CPU 10 to calculate according to the control programs, and includes hardware, such as an integrated circuit. The controller 20 functions as a control unit that controls the entire image forming apparatus 1.

The main control unit 30 controls each of units of the controller 20, and gives instructions to each of the units of the controller 20. The engine control unit 31 serves as a driving unit that controls or drives the print engine 26, the scanner unit 22, and the like. The input/output control unit 32 inputs signals and instructions input via the network I/F 28 to the main control unit 30. The main control unit 30 controls the input/output control unit 32 and accesses other apparatuses via the network I/F 28.

The image processing unit 33 generates drawing information based on print information contained in an input print job under the control of the main control unit 30. The drawing information is information for causing the print engine 26 serving as an image forming unit to draw an image to be formed in image forming operation. The print information contained in the print job is image information in a format that is converted by a printer driver installed in an information processing apparatus, such as a PC, so as to be recognized by the image forming apparatus 1. The operation display control unit 34 displays information on the display panel 24 or notifies the main control unit 30 of information input via the display panel 24.

When the image forming apparatus 1 operates as a printer, the input/output control unit 32 receives a print job via the network I/F 28. The input/output control unit 32 sends the received print job to the main control unit 30. Upon receiving the print job, the main control unit 30 causes the image processing unit 33 to generate the drawing information based on the print information contained in the print job.

When the image processing unit 33 generates the drawing information, the engine control unit 31 controls the print engine 26 based on the generated drawing information so as to form an image on a sheet of paper conveyed from the sheet feed table 25. Namely, the print engine 26 functions as the image forming unit. A document on which the image is formed by the print engine 26 is discharged onto the discharge tray 27.

When the image forming apparatus 1 operates as a scanner, the operation display control unit 34 or the input/output control unit 32 sends a scan execution signal to the main control unit 30 according to a scan execution instruction input by a user through operation of the display panel 24 or by an external PC or the like via the network I/F 28. The main control unit 30 controls the engine control unit 31 based on the received scan execution signal.

The engine control unit 31 drives the ADF 21 so as to convey a document being an imaging object set in the ADF 21 to the scanner unit 22. The engine control unit 31 also drives the scanner unit 22 so as to capture an image of the document conveyed by the ADF 21. If a document is directly set in the scanner unit 22 instead of being set in the ADF 21, the scanner unit 22 captures an image of the set document under the control of the engine control unit 31. Namely, the scanner unit 22 serves as an imaging unit.

In the imaging operation, an imaging element, such as a charge coupled device (CCD), contained in the scanner unit 22 optically scans the document, and imaging information is generated based on the optical information. The engine control unit 31 sends the imaging information generated by the scanner unit 22 to the image processing unit 33. The image processing unit 33 generates image information based on the imaging information received from the engine control unit 31 under the control of the main control unit 30. The image information generated by the image processing unit 33 is stored in a storage medium, such as an HDD 14, attached to the image forming apparatus 1. Namely, the scanner unit 22, the engine control unit 31, and the image processing unit 33 function as a document reading unit in cooperation with one another.

The image information generated by the image processing unit 33 remains stored in the HDD 14 or the like or is transmitted to an external apparatus via the input/output control unit 32 and the network I/F 28, according to an instruction by a user. Namely, the ADF 21 and the engine control unit 31 function as an image input unit.

When the image forming apparatus 1 operates as a copier, the image processing unit 33 generates drawing information based on the imaging information that the engine control unit 31 has received from the scanner unit 22 or based on the image information generated by the image processing unit 33. The engine control unit 31 drives the print engine 26 based on the drawing information in the same manner as the printer operation.

Figure 3:
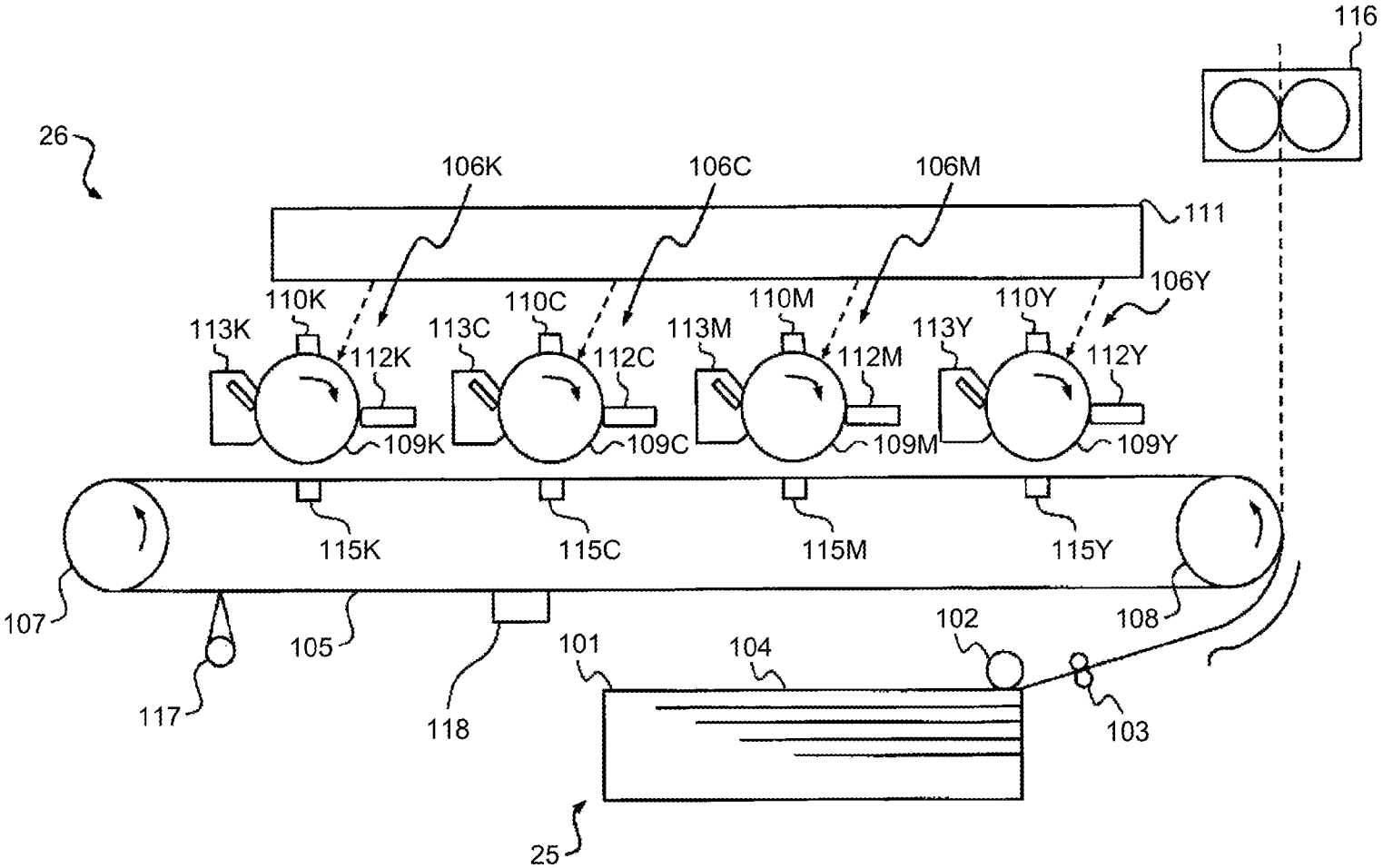
FIG. 3 is a diagram illustrating a configuration of a print engine according to the embodiment of the present invention.

A configuration of the print engine 26 according to the embodiment will be explained below with reference to FIG. 3. As illustrated in FIG. 3, the print engine 26 according to the embodiment is a so-called tandem type, in which image forming units 106 for respective colors are arranged along a conveying belt 105 that is an endless moving unit. Specifically, a plurality of image forming units (electrophotographic process units) 106Y, 106M, 106C, and 106K (hereinafter, collectively referred to as "the image forming unit 106" as appropriate) are arranged in this order from the upstream side in the conveying direction of the conveying belt 105, along the conveying belt 105 serving as an intermediate transfer belt, on which an intermediate transfer image is formed that is to be transferred to a sheet of paper 104 (an example of a recording medium) separated and fed from a sheet feed tray 101 by a sheet feed roller 102.

The sheet of paper 104 fed from the sheet feed tray 101 is temporarily stopped by a registration roller 103, and thereafter fed to a transfer position at which an image is transferred from the conveying belt 105, in synchronization with an image formation timing of the image forming unit 106.

The image forming units 106Y, 106M, 106C, and 106K have the same internal configurations except that the colors of toner images to be formed are different. Specifically, the image forming unit 106K forms a black image, the image forming unit 106M forms a magenta image, the image forming unit 106C forms a cyan image, and the image forming unit 106Y forms a yellow image. In the following, the image forming unit 106Y will be explained in detail. Components of the other image forming units 106M, 106C, and 106K are the same as those of the image forming unit 106Y; therefore, explanation thereof will be omitted by denoting the components by respective symbols M, C, and K instead of a symbol Y assigned to the components of the image forming unit 106Y in the drawings.

The conveying belt 105 is an endless belt, that is, a loop belt, extended around a driving roller 107 and a driven roller 108 that are driven to rotate. The driving roller 107 is rotated by a driving motor (not illustrated). The driving motor, the driving roller 107, and the driven roller 108 function as a driving unit that moves the conveying belt 105 serving as the endless moving unit.

In image formation, the image forming unit 106Y first transfers a black toner image to the conveying belt 105 being rotated. The image forming unit 106Y includes a photosensitive drum 109Y as a photoreceptor, and also includes a charging unit 110Y, an optical writing device 111, a developing unit 112Y, a photoreceptor cleaner (not illustrated), and a neutralizing unit 113Y that are arranged around the photosensitive drum 109Y. The optical writing device 111 applies light to each of the photosensitive drums 109Y, 109M, 109C, and 109K (hereinafter, collectively referred to as "the photosensitive drum 109" as appropriate).

In the image formation, the charging unit 110Y uniformly charges an outer surface of the photosensitive drum 109Y in a dark environment and optical writing is performed with light from a light source corresponding to the black image in the optical writing device 200, so that an electrostatic latent image is formed. The developing unit 112Y develops the electrostatic latent image with yellow toner, so that a yellow toner image is formed on the photosensitive drum 109Y.

The toner image is transferred to the conveying belt 105 by a transfer unit 115Y at a position (transfer position) at which the photosensitive drum 109Y and the conveying belt 105 come into contact with or come closest to each other. Through the transfer, the yellow toner image is formed on the conveying belt 105. After the transfer of the toner image is completed, residual toner remaining on the outer surface of the photosensitive drum 109Y is removed by the photoreceptor cleaner and the photosensitive drum 109Y is neutralized by the neutralizing unit 113Y to wait for next image formation.

The yellow toner image transferred to the conveying belt 105 by the image forming unit 106Y as described above is conveyed to the next image forming unit 106M due to the rotation of the rollers of the conveying belt 105. In the image forming unit 106M, a magenta toner image is formed on the photosensitive drum 109M through the same process as the process for forming the image by the image forming unit 106Y, and the magnet toner image is transferred onto the already-transferred yellow toner image in a superimposed manner.

The yellow and magenta toner images transferred to the conveying belt 105 are further conveyed to the subsequent image forming units 106C and 106K, and a cyan toner image formed on the photosensitive drum 109C and a black toner image formed on the photosensitive drum 109K are transferred onto the already-transferred images in a superimposed manner through the same operation. As a result, a full-color intermediate transfer image is formed on the conveying belt 105.

The sheets of paper 104 housed in the sheet feed tray 101 are fed in order from the topmost sheet, and the intermediate transfer image formed on the conveying belt 105 is transferred to the sheet of paper at a position at which a conveying path of the sheet comes into contact with or comes closest to the conveying belt 105. Therefore, an image is formed on the sheet of paper 104. The sheet of paper 104 on which the image is formed is further conveyed to a fixing unit 116 at which the image is fixed, and then discharged to the outside of the image forming apparatus.

In the image forming apparatus as described above, if the conveying speed of the conveying belt 105 to convey the images transferred from the respective photosensitive drums 109 and the conveying speed of the sheet of paper 104 fed from the sheet feed tray 101 are not synchronized, the image transferred to the sheet of paper may be expanded or contracted in the sub-scanning direction. Therefore, the image forming unit 106 forms an image by changing the scale of the image in the sub-scanning direction according to the ratio of the conveying speed of the sheet of paper and the conveying speed of the conveying belt.

Furthermore, in the image forming apparatus 1 as described above, the toner images of the respective colors may not be superimposed at a position at which the images are expected to be superimposed, and a positional deviation between the colors may occur because of an error in the center-to-center distance between the photosensitive drums 109Y, 109M, 109C, and 109K, an error in the parallelism between the photosensitive drums 109Y, 109M, 109C, and 109K, an error in the installation position of a light-emitting diode array (LEDA) 130 inside the optical writing device 111, or an error in the write timings of the electrostatic latent images on the photosensitive drums 109Y, 109M, 109C, and 109.

Moreover, due to the same cause, an image may be transferred to an area outside an area where the image is expected to be transferred to the sheet of paper serving as a transfer object. As components of the positional deviation as described above, skew, misregistration in the sub-scanning direction, and the like are mainly known. Besides, contraction of the conveying belt due to a change in the internal temperature of a device and degradation over time are also known.

To correct the positional deviation as described above, a pattern detection sensor 117 is provided as illustrated in FIG. 3. The pattern detection sensor 117 comprises a plurality of optical sensors for reading a positional deviation correction pattern and a density correction pattern transferred by the photosensitive drums 109Y, 109M, 109C, and 109K onto the conveying belt 105. The optical sensors are corresponding to two sensor elements 170 in the example shown in the after-mentioned FIG. 6. Each of the optical sensors includes a light-emitting element (not shown) for irradiating the correction patterns drawn on the surface of the conveying belt 105 and a light-receiving element (not shown) for receiving reflected light from the correction patterns. The optical sensors included in the pattern detection sensor 117 are supported on a common supporting member along the direction perpendicular to the conveying direction of the conveying belt 105 on the downstream side of the photosensitive drums 109Y, 109M, 109C, and 109K.

Furthermore, in the image forming apparatus 1, the density of an image transferred to the sheet of paper 104 may vary due to a change in the state of the image forming unit 106Y, 106M, 106C, or 106K or a change in the state of the optical writing device 111. To correct a variation in the density, density correction is performed, in which a density correction pattern that is formed according to a predetermined rule is detected and a drive parameter of the image forming unit 106Y, 106M, 106C, or 106K or a drive parameter of the optical writing device 111 is corrected based on the detection result.

The pattern detection sensor 117 is used for detection of the density correction pattern, in addition to positional deviation correction operation based on detection of the positional deviation correction pattern. Details of the pattern detection sensor 117 and embodiments of the positional deviation correction and the density correction will be explained in detail below.

To remove toner of the correction patterns drawn on the conveying belt 105 in order to prevent a sheet of paper conveyed by the conveying belt 105 from getting dirty during the drawing parameter correction as described above, a belt cleaner 118 is provided. As illustrated in FIG. 3, the belt cleaner 118 is a cleaning blade pressed against the conveying belt 105 on the downstream side of the pattern detection sensor 117 and on the upstream side of the photosensitive drum 109, and serves as a developer removing unit that scrapes off toner attached to the surface of the conveying belt 105.

Figure 4:
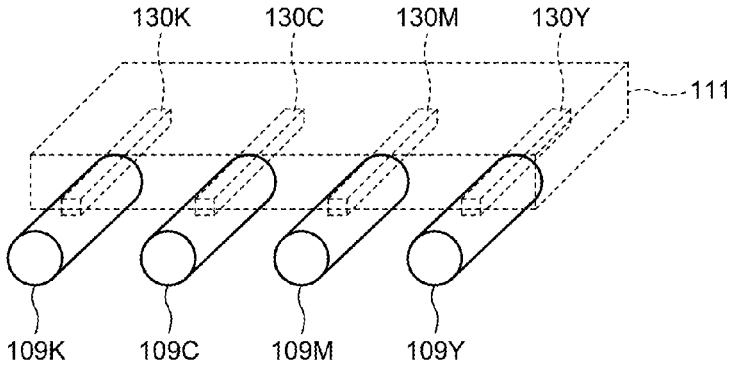
FIG. 4 is a diagram illustrating a configuration of an optical writing device according to the embodiment of the present invention.

The optical writing device 111 according to the embodiment will be explained below. FIG. 4 is a diagram illustrating a positional relationship between the optical writing device 111 according to the embodiment and the photosensitive drum 109. As illustrated in FIG. 4, LEDAs 130Y, 130M, 130C, and 130K (hereinafter, collectively referred to as "the LEDA 130" as appropriate) serving as light sources respectively apply illumination light to the photosensitive drums 109Y, 109M, 109C, and 109K of the respective colors.

In the LEDA 130, light emitting diodes (LEDs) serving as light-emitting elements are arranged in the main-scanning direction of the photosensitive drum 109. A control unit included in the optical writing device 111 controls the on/off state of each of the LEDs arranged in the main-scanning direction based on the drawing information input from the controller 20 for each main-scanning line, to thereby selectively expose the surface of the photosensitive drum 109 to form an electrostatic latent image.

Figure 5:
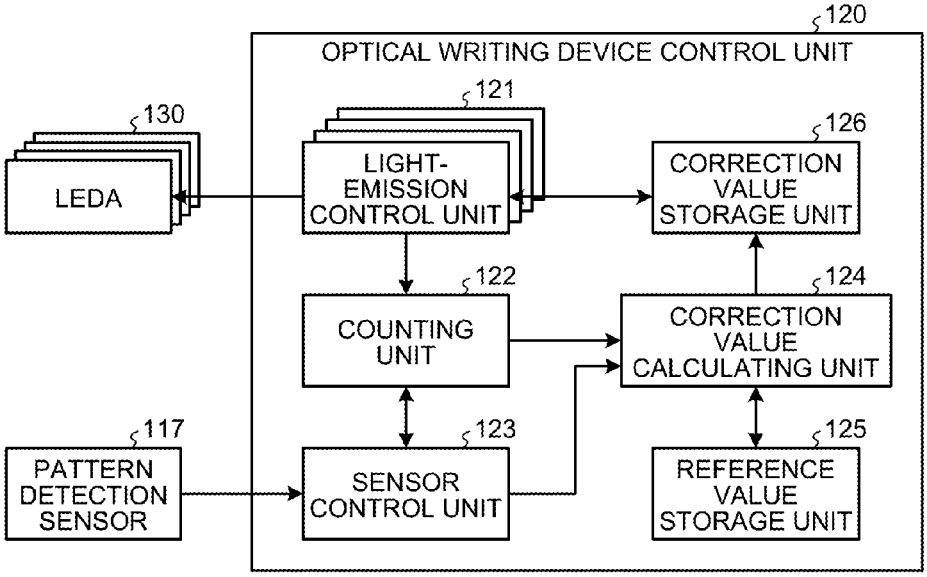
FIG. 5 is a block diagram illustrating configurations of an optical writing device control unit and an LEDA a light-emitting diode array) according to the embodiment of the present invention.

Control blocks of the optical writing device 111 according to the embodiment will be explained below with reference to FIG. 5. FIG. 5 is a diagram illustrating a functional configuration of an optical writing device control unit 120 that controls the optical writing device 111 according to the embodiment, and a connection relation of the LEDA 130 and the pattern detection sensor 117.

As illustrated in FIG. 5, the optical writing device control unit 120 according to the embodiment includes a light-emission control unit 121, a counting unit 122, a sensor control unit 123, a correction value calculating unit 124, a reference value storage unit 125, and a correction value storage unit 126. Meanwhile, the optical writing device 111 according to the embodiment includes information processing mechanisms, such as the CPU 10, the RAM 11, the ROM 12, and the HDD 14, as explained above with reference to FIG. 1. The optical writing device control unit 120 as illustrated in FIG. 5 is configured by, similarly to the controller 20 of the image forming apparatus 1, loading a control program stored in the ROM 12 or the HDD 14 into the RAM 11 and executing the program under the control of the CPU 10.

The light-emission control unit 121 is a light source control unit that controls the LEDA 130 based on the image information input from the engine control unit 31 of the controller 20. Specifically, the light-emission control unit 121 also functions as a pixel information acquiring unit. The light-emission control unit 121 causes the LEDA 130 to emit light with a predetermined line period to perform optical writing on the photosensitive drum 109.

The line period with which the light-emission control unit 121 controls light emission of the LEDA 130 is determined based on the output resolution of the image forming apparatus 1. However, if the scale in the sub-scanning direction is changed according to the ratio of the conveying speed of the sheet of paper as described above, the light-emission control unit 121 adjusts the line period in order to change the scale in the sub-scanning direction.

The light-emission control unit 121 also controls the light emission of the LEDA 130 in order to draw a correction pattern in the drawing parameter correction as described above, as well as to drive the LEDA 130 based on the drawing information input from the engine control unit 31.

As explained above with reference to FIG. 4, a plurality of the LEDAs 130 are provided for the respective colors. Therefore, as illustrated in FIG. 5, a plurality of the light-emission control units 121 are provided so as to correspond to the respective LEDAs 130. A correction value generated through a positional deviation correction process among drawing parameter correction processes is stored, as a positional deviation correction value, in the correction value storage unit 126 illustrated in FIG. 5. The light-emission control unit 121 corrects a drive timing of the LEDA 130 based on the positional deviation correction value stored in the correction value storage unit 126.

Specifically, the light-emission control unit 121 corrects the drive timing of the LEDA 130 by delaying a timing at which the LEDA 130 is driven to emit light, in particular, by shifting a line, based on the drawing information input from the engine control unit 31. However, because pieces of the drawing information are sequentially input from the engine control unit 31 with a predetermined period, it is necessary to store the input pieces of the drawing information and delay a read timing in order to shift the line to delay the light emission timing.

Therefore, the light-emission control unit 121 includes a line memory serving as a storage medium for storing the drawing information input for each main-scanning line, and stores the pieces of the drawing information input from the engine control unit 31 in the line memory.

The counting unit 122 starts counting at the same time as the light-emission control unit 121 causes the LEDA 130 to start exposing the photosensitive drum 109K in the positional deviation correction process as described above. The counting unit 122 acquires a detection signal that the sensor control unit 123 outputs by detecting the positional deviation correction pattern based on an output signal of the pattern detection sensor 117. Namely, the sensor control unit 123 functions as a detection signal acquiring unit. The sensor control unit 123 also inputs, to the correction value calculating unit 124, a count value obtained at the time the detection signal is acquired. Namely, the counting unit 122 functions as a detection timing acquiring unit that acquires a pattern detection timing.

The sensor control unit 123 is a control unit that controls the pattern detection sensor 117, and as described above, outputs a detection signal by determining that the positional deviation correction pattern formed on the conveying belt 105 has reached the position of the pattern detection sensor 117 based on the output signal of the pattern detection sensor 117. Namely, the sensor control unit 123 functions as the detection signal acquiring unit that acquires a pattern detection signal from the pattern detection sensor 117.

In the density correction based on the density correction pattern, the sensor control unit 123 acquires signal intensity of the output signal of the pattern detection sensor 117, and inputs the signal intensity to the correction value calculating unit 124. Furthermore, the sensor control unit 123 adjusts a detection timing of the density correction pattern according to a detection result of the positional deviation correction pattern. Namely, the sensor control unit 123 functions as a density-correction-pattern detection timing determining unit. This adjustment of the detection timing of the density correction pattern by the sensor control unit 123 is one of the main features of the embodiment, which will be described in detail later.

The correction value calculating unit 124 calculates a correction value based on the count value acquired from the counting unit 122, the signal intensity of the detection result of the density correction pattern acquired from the sensor control unit 123, and reference values for the positional deviation correction and the density correction that are stored in the reference value storage unit 125. Namely, the correction value calculating unit 124 functions as a reference value acquiring unit and a correction value calculating unit. The reference value storage unit 125 stores therein reference values used for calculations as described above.

Figure 6:
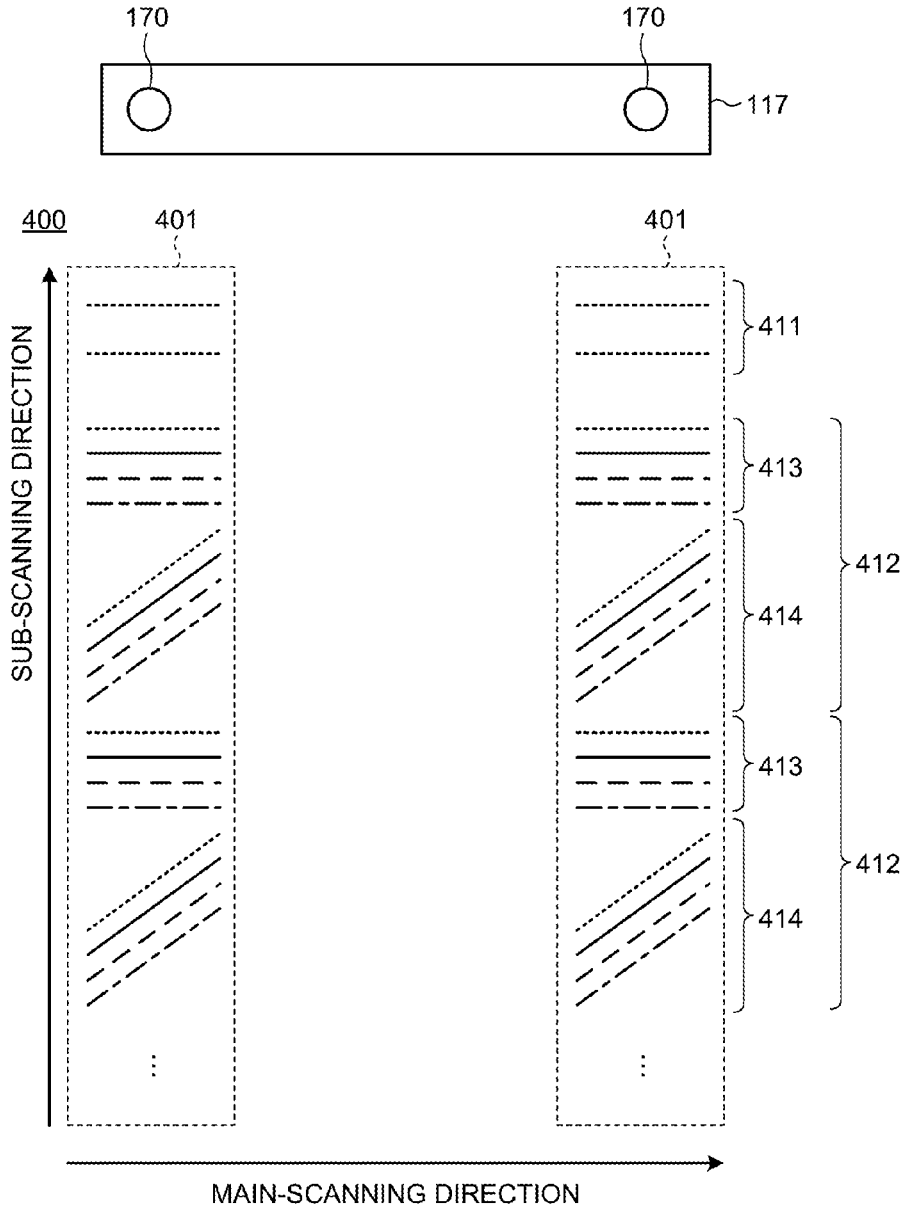
FIG. 6 is a diagram illustrating an example of a positional deviation correction pattern according to the embodiment of the present invention.

Positional deviation correction operation according to the embodiment will be explained below. FIG. 6 is a diagram illustrating a mark (hereinafter, referred to as "a positional deviation correction mark") drawn on the conveying belt 105 by the LEDA 130 controlled by the light-emission control unit 121 in the positional deviation correction operation according to the embodiment.

As illustrated in FIG. 6, a positional deviation correction mark 400 according to the embodiment contains a plurality of positional deviation correction pattern rows 401 (two in the embodiment) arranged in the main-scanning direction, each of which contains various patterns arranged in the sub-scanning direction. In FIG. 6, solid lines indicate patterns drawn by the photosensitive drum 109K, dotted lines indicate patterns drawn by the photosensitive drum 109Y, dashed lines indicate patterns drawn by the photosensitive drum 109C, and chain lines indicate patterns drawn by the photosensitive drum 109M.

As illustrated in FIG. 6, the pattern detection sensor 117 includes a plurality of sensor elements 170 (two in the embodiment) arranged in the main-scanning direction, and each of the sensor elements 170 includes a light-emitting element (not shown) for irradiating the correction patterns drawn on the surface of the conveying belt 105 and a light-receiving element (not shown) for receiving reflected light from the correction patterns The positional deviation correction pattern rows 401 are drawn at positions corresponding to the respective sensor elements 170. Therefore, the optical writing control unit 120 can detect the patterns at multiple positions in the main-scanning direction, so that it becomes possible to correct skew of an image to be drawn.

As illustrated in FIG. 6, each of the positional deviation correction pattern rows 401 contains an entire position correction pattern 411 and drum-interval correction patterns 412. As illustrated in FIG. 6, the drum-interval correction patterns 412 are repeatedly drawn.

The entire position correction pattern 411 according to the embodiment is formed of lines that are drawn by the photosensitive drum 109Y and parallel to the main-scanning direction as illustrated in FIG. 6. The entire position correction pattern 411 is a pattern drawn to obtain a count value for correcting a deviation of an entire image in the sub-scanning direction. The entire position correction pattern 411 is also used to correct a detection timing when the sensor control unit 123 detects the drum-interval correction patterns 412.

In the entire position correction using the entire position correction pattern 411, the optical writing device control unit 120 corrects a write start timing based on a read signal of the entire position correction pattern 411 read by the pattern detection sensor 117.

The drum-interval correction patterns 412 are patterns drawn to obtain a count value for correcting a deviation of a drawing timing in each of the photosensitive drums 109 for the respective colors. As illustrated in FIG. 6, each of the drum-interval correction patterns 412 includes sub-scanning direction correction patterns 413 and main-scanning direction correction patterns 414. As illustrated in FIG. 6, the drum-interval correction patterns 412 are formed by repeatedly arranging the sub-scanning direction correction patterns 413, each containing a set of patterns of CMYK colors, and the main-scanning direction correction patterns 414.

The optical writing device control unit 120 performs positional deviation correction in the sub-scanning direction on each of the photosensitive drums 109K, 109M, 109C, and 109Y based on a read signal of the sub-scanning direction correction patterns 413 read by the pattern detection sensor 117, and performs positional deviation correction in the main-scanning direction on each of the photosensitive drums based on a read signal of the main-scanning direction correction patterns 414 read by the pattern detection sensor 117.

Figure 7:
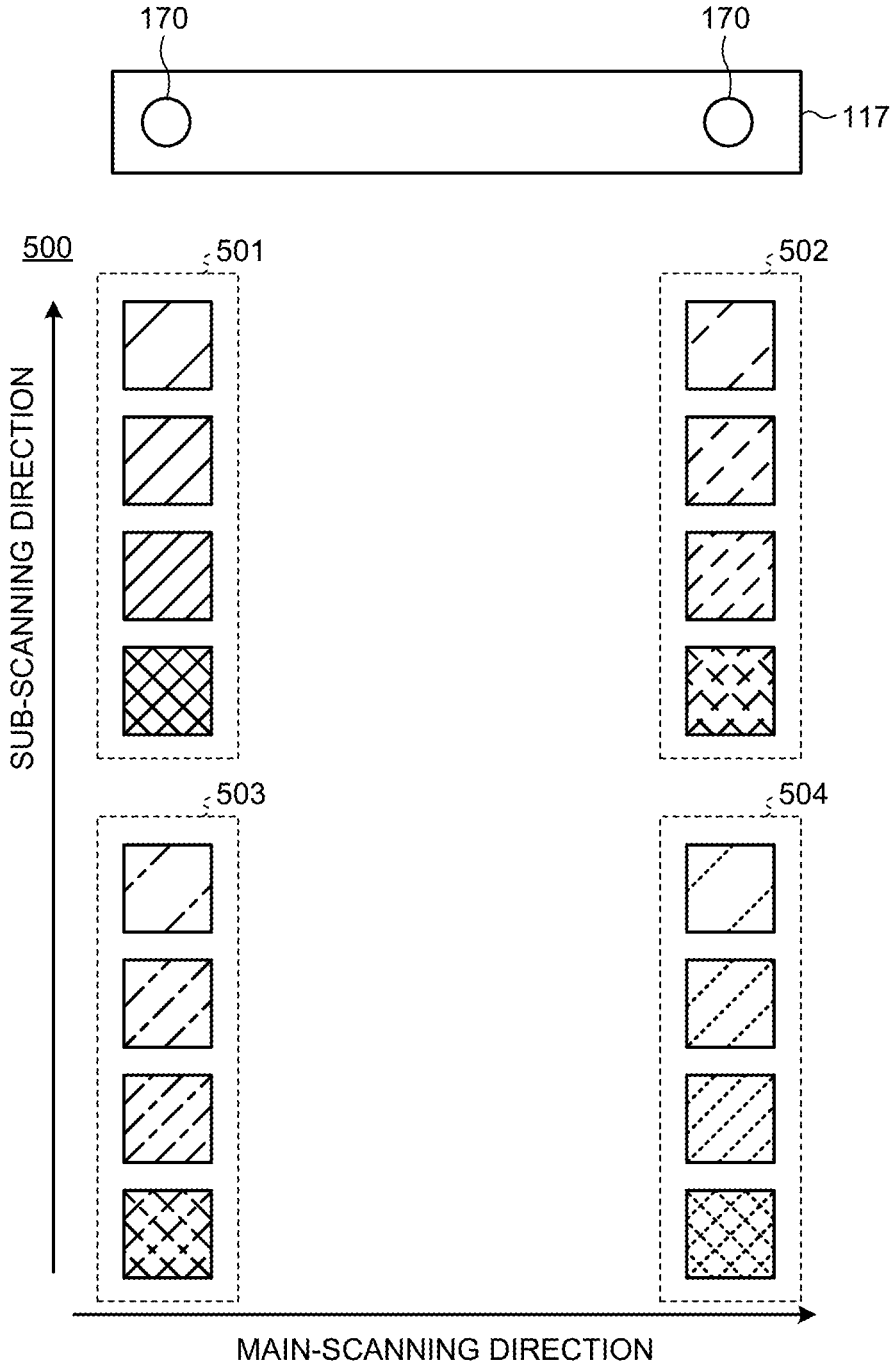
FIG. 7 is a diagram illustrating an example of a density correction pattern according to the embodiment of the present invention.

Density correction operation according to the embodiment will be explained below with reference to FIG. 7. FIG. 7 is a diagram illustrating a mark (hereinafter, referred to as "a density correction mark") drawn on the conveying belt 105 by the LEDA 130 controlled by the light-emission control unit 121 in the density correction operation according to the embodiment. As illustrated in FIG. 7, a density correction mark 500 according to the embodiment contains a black gradation pattern 501, a cyan gradation pattern 502, a magenta gradation pattern 503, and a yellow gradation pattern 504.

In the embodiment, each of the gradation patterns of the respective colors in the density correction mark 500 contains four rectangular patterns with different densities, and the rectangular patterns are arranged in the sub-scanning direction in order of density. The gradation patterns of the respective colors are drawn such that a set of the black pattern and the magenta and a set of the cyan pattern and the yellow pattern are separated into right and left sides. In FIG. 7, the densities of the patterns are distinguished by the number of hatched lines in the rectangular patterns.

Figure 8:
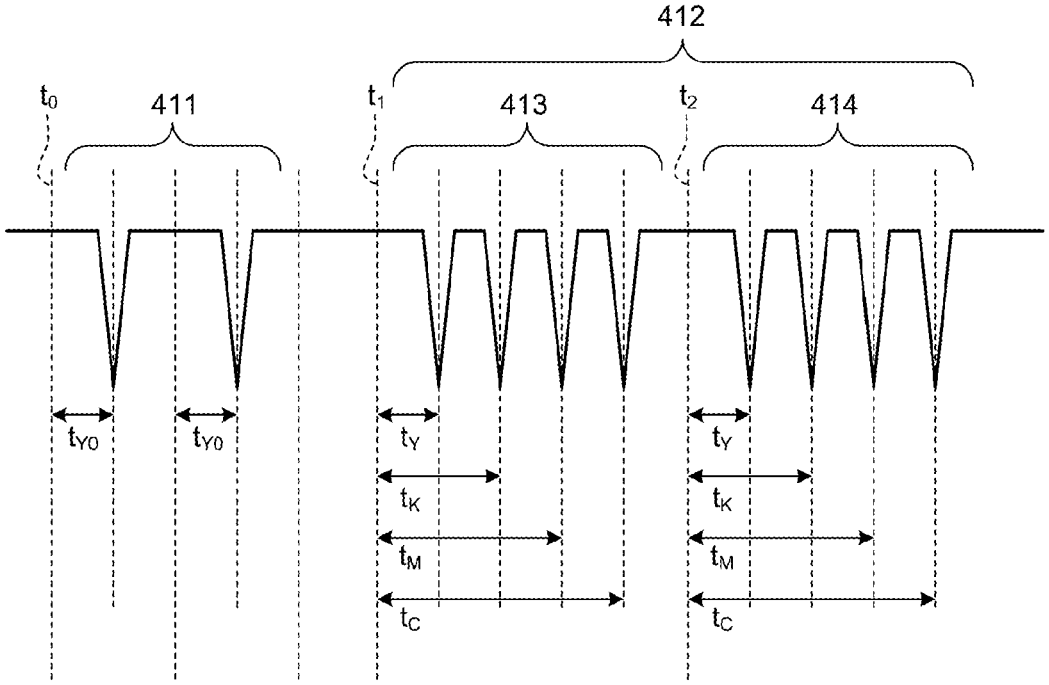
FIG. 8 is a diagram illustrating an example of setting of a detection timing of the positional deviation correction pattern according to the embodiment of the present invention.

In the density correction using the density correction mark 500 illustrated in FIG. 8, the correction value calculating unit 124 acquires, from the sensor control unit 123, information indicating a density based on the intensity of a read signal of each of the gradation patterns of the respective colors read by the pattern detection sensor 117, and corrects developing bias. Specifically, a reference value used for the density correction among the reference values stored in the reference value storage unit 125 is a value serving as a benchmark for the density of each of the four patterns with different densities in each of the gradation patterns of the respective colors.

A timing reference value for each of the colors stored in the reference value storage unit 125 will be explained below with reference to FIG. 8. FIG. 8 is a diagram illustrating detection timings of the entire position correction pattern 411 and the drum-interval correction pattern 412. As illustrated in FIG. 8, a detection period $t_{Y0}$ of the entire position correction pattern 411 starts from a detection start timing $t_0$ that is earlier than a timing at which the lines drawn by the photosensitive drum 109Y are read.

Detection periods $t_Y$, $t_K$, $t_M$, and $t_C$ of the sub-scanning direction correction pattern 413 and the main-scanning direction correction pattern 414 contained in the drum-interval correction pattern 412 start from start timings $t_1$ and $t_2$ that are earlier than a timing at which a set of the patterns is read.

The reference value storage unit 125 stores therein reference values of the detection period $t_{Y0}$ of the entire position correction pattern 411 and the detection periods $t_Y$, $t_K$, $t_M$, and $t_C$ of the sub-scanning direction correction pattern 413 and the main-scanning direction correction pattern 414 illustrated in FIG. 8. In other words, the reference value storage unit 125 stores therein, as the reference values, theoretical values of the detection period $t_{Y0}$ of the entire position correction pattern 411 and the detection periods $t_Y$, $t_K$, $t_M$, and $t_C$ of the sub-scanning direction correction pattern 413 and the main-scanning direction correction pattern 414 that are obtained when the components of the image forming apparatus are configured as designed.

Specifically, the correction value calculating unit 124 calculates a difference between the reference value stored in the reference value storage unit 125 and each of the detection periods $t_Y$, $t_K$, $t_M$, and $t_C$ illustrated in FIG. 8 to obtain a deviation from a design value of the image forming apparatus in which the correction value calculating unit 124 is installed, and calculates a correction value for correcting a light emission timing of the LEDA 130 based on the deviation.

The reference value of the detection period $t_{Y0}$ of the entire position correction pattern 411 is also used to correct the detection start timings $t_1$ and $t_2$ illustrated in FIG. 8. Specifically, the correction value calculating unit 124 calculates a correction value for correcting the detection start timings $t_1$ and $t_2$ illustrated in FIG. 8 based on a difference between the detection period $t_{Y0}$ of the entire position correction pattern 411 and a corresponding reference value. Therefore, it is possible to improve the accuracy of the detection period of the drum-interval correction pattern 412.

To detect the positional deviation correction mark 400 and the density correction mark 500 by the pattern detection sensor 117, the pattern detection sensor 117 applies spot light and detects the intensity of reflected light of the spot light. In this case, because the positional deviation correction mark 400 is used to correct a positional deviation of an image to be drawn based on a pattern detection timing, the light intensity of the reflected light need not be highly accurate.

In contrast, the density correction mark 500 is used to correct the density of an image based on the light intensity of the reflected light, so that the light intensity of the reflected light needs to be highly accurate in order to perform density correction with high accuracy. Therefore, to detect the density correction mark 500, it is necessary to drive the pattern detection sensor 117 so that the spot light from the pattern detection sensor 117 is not applied across an area of the density correction mark 500 and an area of a background color of the conveying belt 105 but is applied within the area of the density correction mark 500.

To drive the pattern detection sensor 117 as described above, if the density correction mark 500 is drawn in a greater size, the spot diameter can easily fall within the area of the pattern even when the timing slightly varies. However, if the density correction mark 500 is drawn in a greater size, the toner consumption is increased accordingly. Therefore, there is a need to draw the density correction mark 500 as small as possible, and more preferably, in a minimum size to cover the spot diameter of the pattern detection sensor 117.

It is possible to draw the density correction mark 500 in the minimum size as described above if the positional deviation correction using the positional deviation correction mark 400 is performed with high accuracy. However, because the electrophotographic image forming apparatus includes complicated mechanisms as explained above with reference to FIG. 3, it is difficult to adjust the positions with high accuracy.

For example, even when the same patterns are drawn by performing adjustment according to the ratio of the conveying speed of the sheet of paper and the conveying speed of the conveying belt as described above, because a detection interval between the patterns varies, it becomes difficult to perform the positional deviation correction with high accuracy.

Furthermore, as described above, while the detection periods $t_Y$, $t_K$, $t_M$, and $t_C$ illustrated in FIG. 8 start from the predetermined timings $t_1$ and $t_2$ and are significant for calculating the amount of correction for color misregistration between colors, the detection periods $t_Y$, $t_K$, $t_M$, and $t_C$ are not sufficient to accurately obtain a period from when the patterns of the respective colors are formed by exposure of the photosensitive drum 109 to when the patterns reach the pattern detection sensor 117.

A case will be explained below that a detection timing is set in the pattern detection sensor 117 to detect a pattern drawn on the photosensitive drum 109 of each of the image forming units 106 when the image forming units 106 of the respective colors and the pattern detection sensor 117 are arranged with the positional relationship as illustrated in the FIG. 3.

In this case, basically, a timing at which each of the image forming units 106 starts drawing a pattern, that is, a timing at which the optical writing device 111 starts exposing the photosensitive drum 109, is used as a starting point, and a period from the starting point to when an electrostatic latent image formed by the exposure is developed, transferred to the conveying belt 105, and finally conveyed to a detection position of the pattern detection sensor 117 is counted to set a detection timing.

If it is possible to provide a counter for each of the image forming units 106, that is, for each of the colors, the detection timing can be determined in a simple way. However, a method generally employed is to provide only a single counter to reduce costs of the apparatus, and add a difference value according to the positional relationship between the respective colors by using the counter as a substitute.

For example, when the image forming units 106 are arranged with the positional relationship as illustrated in FIG. 3, a detection timing of a pattern drawn by the image forming unit 106Y can be set easily by setting, as a reference detection timing, a timing at which a period starting from an exposure start timing of the photosensitive drum 109Y and corresponding to a design value ends, and applying a correction value calculated based on a detection result of the entire position correction pattern 411.

To detect a detection timing of a pattern drawn by the image forming unit 106M, the detection timing set for the image forming unit 106 is used as a reference, with respect to which a difference between an exposure start timing for the image forming unit 106Y and an exposure start timing for the image forming unit 106M is added and a conveying period corresponding to a distance between the transfer position from the photosensitive drum 109Y to the conveying belt 105 and the transfer position from the photosensitive drum 109M to the conveying belt 105 as illustrated in FIG. 3 is subtracted.

Subsequently, a correction value calculated based on a detection result of the entire position correction pattern 411 and a correction value calculated based on the sub-scanning direction correction pattern 413 are applied to set the detection timing of the pattern drawn by the image forming unit 106M.

The calculation as described above is performed based on the assumption that a period from a start of exposure of the photosensitive drum 109 to transfer of a toner image to the conveying belt 105 is not taken into account and a detection timing of a pattern of each of the colors is defined based on a distance between the transfer position from the photosensitive drum 109Y to the conveying belt 105 and the transfer position from the photosensitive drum 109M to the conveying belt 105 illustrated in FIG. 3.

However, an error may occur in the period from the start of the exposure of the photosensitive drum 109 to the transfer of the toner image to the conveying belt 105 due to an eccentricity of the photosensitive drum 109, a change in the drum diameter, or an individual variability between motors that rotate the photosensitive drums. Therefore, the detection timing of the pattern may be deviated due to the error.

In the embodiment, a detection timing of the density correction mark 500 is set by taking the above factors into account, so that the detection timing of the density correction mark 500 can be set with accuracy. Therefore, it becomes possible to reduce a margin of error in the detection timing when the density correction mark 500 is drawn and to reduce the toner consumption caused by drawing of the density correction mark 500.

Figure 9:
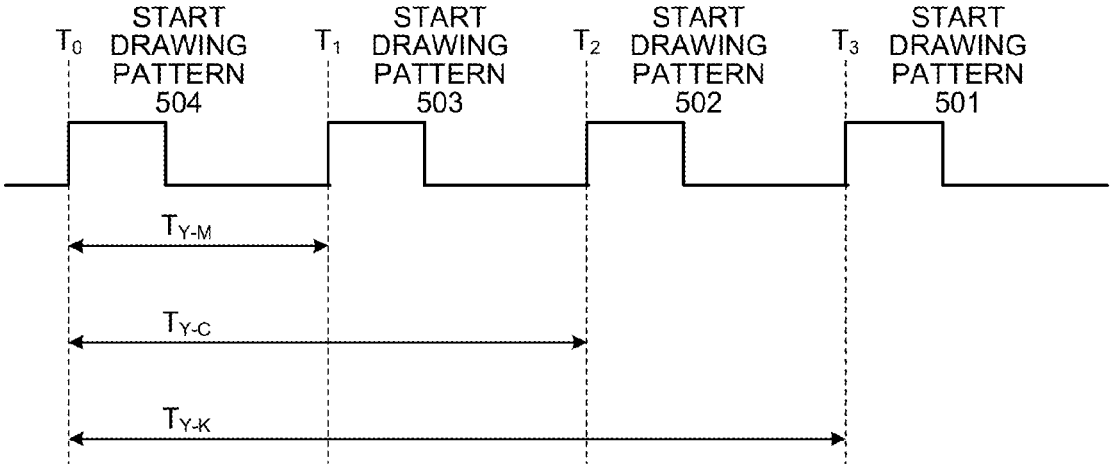
FIG. 9 is a diagram illustrating an example of a write start timing of the density correction pattern according to the embodiment of the present invention.

A calculation method for setting a detection timing of each of the black gradation pattern 501, the cyan gradation pattern 502, the magenta gradation pattern 503, and the yellow gradation pattern 504 contained in the density correction mark 500 according to the embodiment will be explained below. FIG. 9 is a diagram illustrating an example of a pattern drawing start timing of each of the colors, that is, an exposure start timing for the photosensitive drum 109, to draw the density correction mark 500 according to the embodiment.

As illustrated in FIG. 9, exposure to draw the yellow gradation pattern 504 is first started at a timing $T_0$. Subsequently, when a period $T_{Y\text{-}M}$ has elapsed, exposure to draw the magenta gradation pattern 503 is started at a timing $T_1$. The period $T_{Y\text{-}M}$ is set so that the position of the yellow gradation pattern 504, which has already started to be drawn, and the position of the magenta gradation pattern 503 coincide with each other in the sub-scanning direction.

Furthermore, when a period $T_{Y\text{-}C}$ has elapsed after the timing $T_0$, exposure to draw the cyan gradation pattern 502 is started at a timing $T_2$. The period $T_{Y\text{-}C}$ is set so that the cyan gradation pattern 502 can be transferred at a position just before the yellow gradation pattern 504 which has already started to be drawn.

Moreover, when a period $T_{Y\text{-}K}$ has elapsed after the timing $T_0$, exposure to draw the black gradation pattern 501 is started at a timing $T_3$. The period $T_{Y\text{-}K}$ is set so that the position of the cyan gradation pattern 502, which has already started to be drawn, and the position of the black gradation pattern 501 coincide with each other in the sub-scanning direction.

Figure 10:
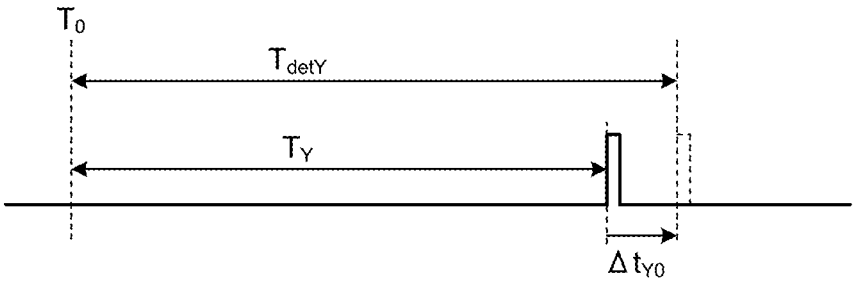
FIG. 10 is a diagram illustrating an example of setting of a detection timing of the density correction pattern according to the embodiment of the present invention.

FIG. 10 is a diagram illustrating a calculation method for setting a detection timing of the yellow gradation pattern 504. As illustrated in FIG. 10, to calculate a detection timing $T_{detY}$ of the yellow gradation pattern 504, the sensor control unit 123 performs a calculation by using the drawing start timing $T_0$ as a starting point, and by using a designed period $T_Y$, namely a theoretical value that is the period from when the exposure of the yellow gradation pattern 504 in FIG. 9 is started and then the toner image developed by the exposure is conveyed by the conveying belt 105, to when the conveyed toner image reaches the pattern detection sensor 117. Specifically, the sensor control unit 123 performs the calculation by using as a reference, a timing after it has passed the designed period $T_Y$ from the starting point $T_0$.

Furthermore, as illustrated in FIG. 10, the sensor control unit 123 adds, to the designed period $T_Y$ from the timing $T_0$, a deviation amount $\Delta t_{Y0}$ with respect to a reference value calculated based on a detection result of the entire position correction pattern 411, to thereby calculate the detection timing $T_{detY}$ of the yellow gradation pattern 504.

Incidentally, while $\Delta t_{Y0}$ used in the calculation illustrated in FIG. 10 may be a value calculated based on the detection result of the entire position correction pattern 411, because the sensor element on the right side between the two sensor elements 170 of the pattern detection sensor 117 detects the yellow gradation pattern 504 as illustrated in FIG. 6, it becomes possible to set the detection timing of the density correction mark 500 with higher accuracy by using a value calculated based on only a detection result of the entire position correction pattern 411 obtained by the sensor element 170 on the right side.

Moreover, while the correction value $\Delta t_{Y0}$ acts in the positive direction in FIG. 10, this is described by way of example only. The correction value $\Delta t_{Y0}$ may act in the negative direction depending on a calculation result of the correction value based on the detection result of the entire position correction pattern 411.

Figure 11:
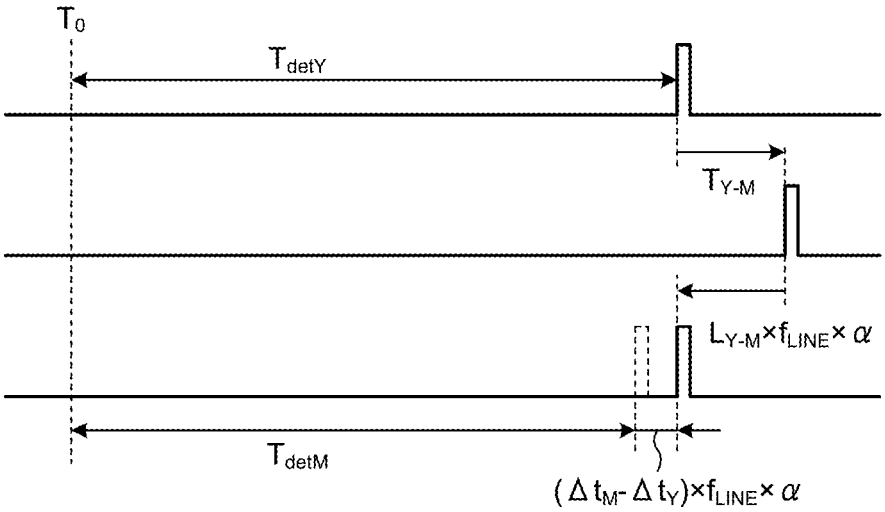
FIG. 11 is a diagram illustrating an example of setting of a detection timing of the density correction pattern according to the embodiment of the present invention.

FIG. 11 is a diagram illustrating a calculation method for setting a detection timing of the magenta gradation pattern 503. As illustrated in FIG. 11, to calculate a detection timing $T_{detM}$ of the magenta gradation pattern 503, the sensor control unit 123 uses the detection timing $T_{detY}$ of the yellow gradation pattern 504 illustrated in FIG. 10 as a reference, and, adds a delay period $T_{Y\text{-}M}$ of the drawing start timing illustrated in FIG. 9 and subtracts a value corresponding to a distance $L_{Y\text{-}M}$ between the transfer position from the photosensitive drum 109Y to the conveying belt 105 and the transfer position from the photosensitive drum 109M to the conveying belt 105.

In this case, the distance $L_{Y\text{-}M}$ is represented by the number of dots corresponding to the distance between the transfer position from the photosensitive drum 109Y to the conveying belt 105 and the transfer position from the photosensitive drum 109M to the conveying belt 105, so that a unit "dot" is used. In contrast, a period to be calculated is represented by a unit "milliseconds (msec)".

Therefore, in the calculation, the sensor control unit 123 multiples the distance $L_{Y\text{-}M}$ by a line period $f_{LINE}$ that is taken to drive the LEDA 130 by the light-emission control unit 121, to thereby convert the unit to "msec". In this case, if an adjustment value $\alpha$ corresponding to the ratio between the conveying speed of the sheet of paper and the conveying speed of the conveying belt is taken into account, it becomes possible to obtain the detection timing of the density correction mark 500 with high accuracy. Incidentally, the adjustment value $\alpha$ is a value of the ratio between the conveying speed of the sheet of paper and the conveying speed of the conveying belt, and is represented by a decimal fraction, such as "0.99" or "1.01".

Furthermore, as illustrated in FIG. 11, the sensor control unit 123 adds a value corresponding to correction values $\Delta t_M$ and $\Delta t_Y$ that are calculated based on the sub-scanning direction correction pattern 413 for the image forming units 106Y and 106M, to thereby calculate the detection timing $T_{detM}$ of the magenta gradation pattern 503. Each of the correction values $\Delta t_M$ and $\Delta t_Y$ is calculated as the number of lines to be shifted when the light-emission control unit 121 drives the LEDA 130. Therefore, to convert the unit, similarly to the distance $L_{Y\text{-}M}$, the value is multiplied by the line period $f_{LINE}$ and the adjustment value $\alpha$.

Incidentally, while a value calculated by the calculation illustrated in FIG. 10 can be used as the detection timing $T_{detY}$ used as a reference in the calculation illustrated in FIG. 11, the magenta gradation pattern 503 is detected by the sensor element 170 on the left side different from the sensor element 170 that detects the yellow gradation pattern 504 as illustrated in FIG. 6. Therefore, if the sensor control unit 123 uses a newly-calculated detection timing $T_{detY}$ obtained by performing the same calculation as that illustrated in FIG. 10 based on only a detection result of the entire position correction pattern 411 obtained by the sensor element 170 on the left side, it becomes possible to set the detection timing of the density correction mark 500 with higher accuracy.

Moreover, while the correction value based on the correction value $(\Delta t_M - \Delta t_Y)$ acts in the negative direction in FIG. 11, this is described by way of example only. The correction value may act in the positive direction depending on a calculation result of the correction value based on the detection result of the sub-scanning direction correction pattern 413.

Figure 12:
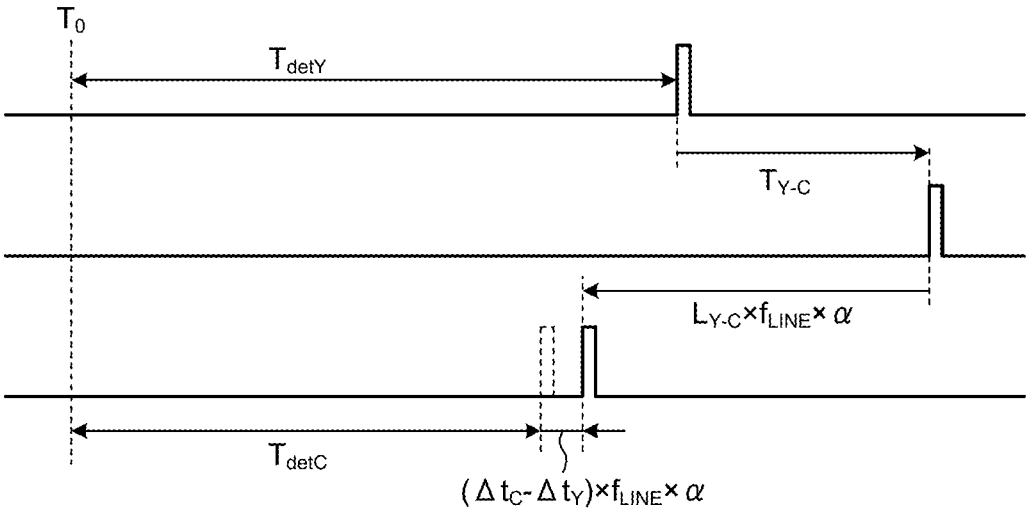
FIG. 12 is a diagram illustrating an example of setting of a detection timing of the density correction pattern according to the embodiment of the present invention.

FIG. 12 is a diagram illustrating a calculation method for setting a detection timing of the cyan gradation pattern 502. As illustrated in FIG. 12, to calculate a detection timing $T_{detC}$ of the cyan gradation pattern 502, the sensor control unit 123 uses the detection timing $T_{detY}$ of the yellow gradation pattern 504 illustrated in FIG. 10 as a reference, and, adds a delay period $T_{Y\text{-}C}$ of the drawing start timing illustrated in FIG. 9 and subtracts a value corresponding to a distance $L_{Y\text{-}C}$ between the transfer position from the photosensitive drum 109Y to the conveying belt 105 and the transfer position from the photosensitive drum 109C to the conveying belt 105.

The sensor control unit 123 converts the unit of the distance $L_{Y\text{-}C}$ based on the line period $f_{LINE}$ and the adjustment value $\alpha$ in the same manner as in the example in FIG. 11. Furthermore, as illustrated in FIG. 12, the sensor control unit 123 adds a value corresponding to correction values $\Delta_C$ and $\Delta t_Y$ that are calculated based on the sub-scanning direction correction pattern 413 for the image forming units 106Y and 106C similarly to the detection timing $T_{detM}$, to thereby calculate the detection timing $T_{detC}$ of the cyan gradation pattern 502.

Figure 13:
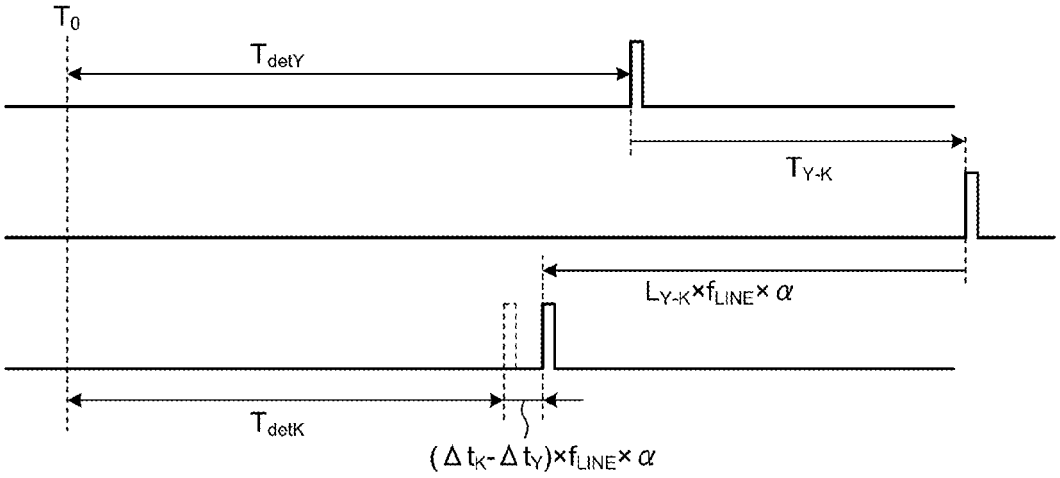
FIG. 13 is a diagram illustrating an example of setting of a detection timing of the density correction pattern according to the embodiment of the present invention.

FIG. 13 is a diagram illustrating a calculation method for setting a detection timing of the black gradation pattern 501. As illustrated in FIG. 13, to calculate a detection timing $T_{detK}$ of the black gradation pattern 501, the sensor control unit 123 uses the detection timing $T_{detY}$ of the yellow gradation pattern 504 illustrated in FIG. 10 as a reference, and, adds a delay period $T_{Y\text{-}K}$ of the drawing start timing illustrated in FIG. 9 and subtracts a value corresponding to a distance $L_{Y\text{-}K}$ between the transfer position from the photosensitive drum 109Y to the conveying belt 105 and the transfer position from the photosensitive drum 109K to the conveying belt 105.

The sensor control unit 123 converts the unit of the distance $L_{Y\text{-}K}$ based on the line period $f_{LINE}$ and the adjustment value $\alpha$ in the same manner as in the example in FIG. 11. Furthermore, as illustrated in FIG. 13, the sensor control unit 123 adds a value corresponding to correction values $\Delta t_K$ and $\Delta t_Y$ that are calculated based on the sub-scanning direction correction pattern 413 for the image forming units 106Y and 106K similarly to the detection timing $T_{detM}$, to thereby calculate the detection timing $T_{detK}$ of the black gradation pattern 501.

As described above, to calculate the detection timing of the density correction mark 500 according to the embodiment, the sensor control unit 123 takes into account the adjustment value $\alpha$ corresponding to the ratio between the conveying speed of the sheet of paper and the conveying speed of the conveying belt, so that it becomes possible to prevent occurrence of a detection error due to the adjustment value $\alpha$.

Furthermore, as explained above with reference to FIGS. 11 to 13, to calculate the detection timing of the density correction mark 500, the sensor control unit 123 uses, as a reference, the drawing start timing of the yellow gradation pattern 504 that is drawn first, and calculates the detection timings of the other gradation patterns of the other colors in the density correction mark 500 based on a wait time to the drawing start timing of each of the gradation patterns and based on an actual positional relationship between the photosensitive drums 109 of the respective colors.

Therefore, it becomes possible to accurately calculate a period from when exposure is started to draw a pattern in the photosensitive drum for each of the colors to when the pattern reaches the pattern detection sensor 117.

Incidentally, to prevent an increase in costs, there is a need to calculate the detection timing illustrated in FIGS. 11 to 13 by using a CPU installed in the optical writing device control unit 120 without installing a special application-specific integrated circuit (ASIC). According to the embodiment, units of all of the values to be processed are converted to the unit "msec", so that it becomes possible to perform density correction with high accuracy by using only a general-purpose CPU without using a special ASIC that can operate with accuracy.

Furthermore, while the optical writing device 111 using the LEDA 130 is explained as an example in the embodiment, the feature of the embodiment is to change the scale in the sub-scanning direction by adjusting the line period. Therefore, any individual scanning write head, such as an organic electroluminescence (EL) head, a laser diode (LD) array head, or a surface-emitting laser, may be employed instead of the LEDA 130.

Moreover, while the positional deviation correction operation for a full-color image is explained as an example in the embodiment, if a full-color image processing apparatus performs monochrome printing, the positional deviation correction operation for a monochrome image is performed. In this case, the same pattern as the entire position correction pattern 411 is formed by the photosensitive drum 109K instead of the positional deviation correction mark 400 illustrated in FIG. 6, and thereafter, only the black gradation pattern 501 illustrated in FIG. 7 is drawn. Meanwhile, the entire position correction pattern 411 drawn by the photosensitive drum 109K is referred to as an entire position correction pattern 411' below.

In this case, a detection period $t_{KO}$ is obtained based on a detection timing of the entire position correction pattern 411', instead of the detection period $t_{Y0}$ illustrated in FIG. 8. To detect the detection timing $T_{detK}$ of the black gradation pattern 501, similarly to the detection timing $T_{detY}$ illustrated in FIG. 10, a deviation amount $\Delta t_{K0}$ with respect to a reference value calculated based on a detection result of the entire position correction pattern 411' is added to the designed period $T_K$. Through the above process, even in the positional deviation correction for a monochrome image, it becomes possible to perform the positional deviation correction in the same manner as described above.

According to an embodiment of the present invention, an electrophotographic image forming apparatus can perform the positional deviation correction in the sub-scanning direction with high accuracy and reduce a drawing area of the density correction pattern.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing control apparatus configured to cause light sources that expose photoreceptors to form electrostatic latent images on the photoreceptors, the optical writing control apparatus comprising:

a light-emission control unit configured to cause a plurality of light sources provided for different colors to emit light based on pixel information of an image to be formed and output, to thereby expose the photoreceptors for the respective colors;

a detection signal acquiring unit configured to acquire a detection signal from a sensor, the sensor being configured to detect images developed from the electrostatic latent images formed on the photoreceptors in a conveying path on which the images are transferred and conveyed; and a density-correction-pattern detection timing determining unit configured to determine a detection timing of a density correction pattern that is used to correct a density of each of the images developed from the electrostatic latent images, based on a detection result of a positional deviation correction pattern that is used to correct a positional deviation between the images developed from the electrostatic latent images of the respective colors in the sub-scanning direction, wherein the light-emission control unit first controls light emission of the light sources for forming the positional deviation correction pattern and thereafter controls light emission of the light sources for forming the density correction pattern, the detection signal acquiring unit acquires the detection signal of the sensor based on the determined detection timing of the density correction pattern, to thereby acquire the detection result of the density correction pattern, and the density-correction-pattern detection timing determining unit determines the detection timing of the density correction pattern by correcting a predetermined timing, which is determined in advance as the detection timing of the density correction pattern, based on a ratio between a conveying speed of a recording medium to which the images developed from the electrostatic latent images are transferred and a conveying speed of the conveying path for conveying the images developed from the electrostatic latent images.

2. The optical writing control apparatus according to claim 1, wherein when controlling exposure of the photoreceptors to form the density correction pattern, the light-emission control unit first starts controlling light emission of a light source that first emits light among the light sources, and thereafter starts controlling light emission of the other light sources after a lapse of a predetermined waiting period, and the density-correction-pattern detection timing determining unit determines a detection timing of a density correction pattern corresponding to the firstly-controlled light source based on the detection result of the positional deviation correction pattern corresponding to the firstly-controlled light source, and also determines detection timings of density correction patterns corresponding to the other light sources based on the predetermined waiting period and based on a positional relationship between the photoreceptor exposed by the firstly-controlled light source and the photoreceptors corresponding to the other light sources.

3. The optical writing control apparatus according to claim 1, wherein when an image is to be formed and output with a single color, the light-emission control unit controls light emission of the light sources so that a transfer position correction pattern used to correct a transfer position at which a developed electrostatic latent image is transferred to a sheet of paper and the density correction pattern can be formed by using the single color, and the density-correction-pattern detection timing determining unit determines the detection timing of the density correction pattern based on a detection result of the transfer position correction pattern.

4. An image forming apparatus comprising the optical writing control apparatus according to claim 1.

5. An optical writing control method for causing light sources that expose photoreceptors to form electrostatic latent images on the photoreceptors, the optical writing control method comprising:

first controlling light emission of the light sources for forming a positional deviation correction pattern that is used to correct a positional deviation between images of different colors developed from the electrostatic latent image formed on the photoreceptors for the respective colors in the sub-scanning direction;

second controlling, after the first controlling, light emission of the light sources for forming a density correction pattern that is used to correct a density of each of the images developed from the electrostatic latent images;

acquiring a detection signal from a sensor, the sensor being configured to detect the images developed from the electrostatic latent images in a conveying path on which the images are transferred and conveyed;

determining a detection timing of the density correction pattern by correcting a predetermined timing, which is determined in advance as the detection timing of the density correction pattern, based on a ratio between a conveying speed of a recording medium to which the images developed from the electrostatic latent images are transferred and a conveying speed of the conveying path for conveying the images developed from the electrostatic latent images; and acquiring a detection result of the density correction pattern by acquiring the detection signal of the sensor according to the determined detection timing of the density correction pattern.

* * * * *